US005459474A

United States Patent [19]

Mattioli et al.

[11] Patent Number: 5,459,474

[45] Date of Patent: Oct. 17, 1995

[54] ACTIVE ARRAY ANTENNA RADAR STRUCTURE

[75] Inventors: Joseph A. Mattioli, Philadelphia, Pa.; Ashok K. Agrawal; Norman R. Landry, both of Mount Laurel, N.J.

[73] Assignee: Martin Marietta Corporation, Moorestown, N.J.

[21] Appl. No.: 215,551

[22] Filed: Mar. 22, 1994

[51] Int. Cl.[6] ..... H01Q 1/24

[52] U.S. Cl. ..... 343/702; 343/772; 343/777; 343/786; 343/853; 343/872; 361/699; 361/733; 361/788; 361/803

[58] Field of Search ..... 343/702, 772, 343/777, 786, 853, 872; 361/730, 733, 785, 788, 803, 698, 699; H01Q 1/24

[56] References Cited

U.S. PATENT DOCUMENTS

| | | | |
|---|---|---|---|
| 3,549,949 | 12/1970 | Granberry | 317/100 |
| 3,936,864 | 2/1976 | Benjamin | 357/74 |
| 4,298,873 | 11/1981 | Roberts | 343/854 X |
| 4,338,609 | 7/1982 | Landry | 343/772 X |
| 4,872,212 | 10/1989 | Roos et al. | 361/788 X |
| 4,947,288 | 8/1990 | Olsson et al. | 361/788 |
| 5,017,927 | 5/1991 | Agrawal et al. | 342/371 |
| 5,103,233 | 4/1992 | Gallagher et al. | 342/408 |
| 5,276,455 | 1/1994 | Fitzsimmons et al. | 343/777 |
| 5,359,339 | 10/1994 | Agrawal et al. | 343/786 |

FOREIGN PATENT DOCUMENTS

| | | | |
|---|---|---|---|
| 1767712 | 10/1992 | U.S.S.R. | 361/699 |

OTHER PUBLICATIONS

Williams et al, "Antenna/Nonmetallics Department Solves a Variety of Packaging Challenges," Jun. 1992, pp. 25–42.

Chu et al, "Compliant Cold Plate Cooling Scheme", IBM Tech Bulletin vol. 21, No. 6, Nov. 1978.

More et al, "Three Dimensional MLC Substrate Integrated Circuit Support Package," IBM Tech Bulletin vol. 20, No. 11A, Apr. 1978.

Chu, "Counter–Flow Cooling System", IBM Tech Bulletin vol. 8 No. 11 Apr. 1966.

*Primary Examiner*—Donald Hajec
*Assistant Examiner*—Steven Wigmore
*Attorney, Agent, or Firm*—W. H. Meise; C. A. Nieves; S. A. Young

[57] ABSTRACT

An active array antenna, which may be used for radar, includes antenna elements (antelements) supported in a two-dimensional array. The fronts of the elements are protected by a cover. In order to allow easy repair, each column of antelements is associated with a slide-in carrier which simultaneously mates with all antelements of a column. Each carrier has a transmit-receive (TR) module for each antelement with which it mates, and a column beamformer. Each carrier also has logic modules and power supplies for the TR modules. The total width of each slide-in carrier with its TR modules, beamformer, logic and power supplies, is less than or equal to the column-to-column spacing. Each carrier can be slid out from the rear to expose all the active components for each column of antelements, so maintenance can be performed without environmental exposure.

13 Claims, 5 Drawing Sheets

ACTIVE ARRAY ANTENNA RADAR STRUCTURE

FIELD OF THE INVENTION

This invention relates to radar systems, and more particularly to active array antenna radar systems physically arranged for reliability and ease of maintenance.

BACKGROUND OF THE INVENTION

Active array antennas are coming into increased use because of their adaptability, low inertia and multi-beam capability. In an active array antenna, each antenna element is associated with a "transmit-receive" (TR) module, which amplifies the signal received by the antenna element to provide a good noise figure and to compensate for losses which occur in the receive beamformer. The TR module may also include a transmit amplifier, which amplifies transmit signals arriving at the TR module from the transmit beamformer, so that each antenna element radiates an amplified signal. The amplified signals radiated by the antenna elements "combine in space" to produce the net transmit power. An air traffic control radar system using active array antennas is described, for example, in U.S. Pat. No. 5,103,233, issued Apr. 7, 1992 in the name of Gallagher et al, incorporated herein by reference.

FIG. 1 is a perspective or isometric view of a shelter as described in the abovementioned Gallagher et al. patent, adapted for supporting phased-array antennas. In FIG. 1, structure 10 is in the form of a truncated quadrilateral pyramid including faces or sides 12 and 14. Structure 10 sits atop a base or foundation 16. Each face 12, 14 of structure 10 bears a planar array antenna 18. Array antenna 18*a* is associated with face 12, array antenna 18*b* is associated with face 14, and two other array antennas are associated with the two hidden faces. Those skilled in the art of array antennas know that array antennas such as antenna 18 may be two-dimensional arrays of hundreds or thousands of antenna elements, and may be of any shape, including the illustrated trapezoidal shape, or rectangular, circular, elliptical, or may even be annular or of some other shape. As described in the abovementioned Gallagher et al. patent, the TR modules and antenna elements of each array may be fed by a corporate feed. Corporate feeds are well known in the art, being described, for example, in U.S. Pat. No. 5,017,927, issued May 21, 1991 in the name of Agrawal et al., which is incorporated herein by reference.

In FIG. 1, a direction broadside (normal to the surface of) to the surface of array 18*b* is illustrated as dash line 24, which makes an angle $\theta_T$ with the horizontal x axis.

When structure 10 of FIG. 1 houses an air traffic control radar system as described in the abovementioned Gallagher et al. patent, economic considerations dictate that it may often be the only all-weather aircraft control system available, and must be very reliable. In the context of a shipboard fleet self-defense radar such as the AEGIS system currently in use, the importance of reliability cannot be overstated. Thus, a radar arrangement and its housing may be required to be very reliable and easily maintained.

SUMMARY OF THE INVENTION

An active array antenna according to the invention includes a plurality of antenna elements (antelements) arrayed over a two-dimensional array plane, with the radiating sides of the antelements facing in a forward direction relative to the two-dimensional array, and with the feed sides of the antelements facing in a rearward direction relative to the forward direction. The array plane defines a normal direction broadside to the array. Each of the antenna elements of the two-dimensional array includes a feed port facing generally toward the rear or feed side of the two-dimensional array. An antenna element support structure supports the antenna elements in their respective positions in the two-dimensional array, and thereby allows radiation generally in the forward direction from the antenna elements. An environmental protection arrangement such as a dielectric window or radome covers at least portions of the radiating sides of the antenna elements, for protecting the antenna elements from adverse environmental conditions. In one embodiment of the invention, a dielectric window is associated with each antelement. A plurality of feed and support arrangements are provided, equal in number to the number of the columns of antelements in the array. Each of the feed and support arrangements is associated with those of the antenna elements of the two-dimensional array which lie in a column. Each of the feed and support arrangements supports a vertical line or column array of antenna element couplers along a forward edge of the feed and support arrangement. The array direction of the column array of couplers is parallel to the direction of elongation of the column of antenna elements of the two-dimensional array, and each of the antenna element couplers is adapted, in response to motion of the column array of antenna element couplers in a direction normal to the column array of antenna element couplers toward the column array of antenna elements, for mating with the feed port of one of the antenna elements of the associated column of antenna elements, for coupling energy between the antenna element couplers and the associated ones of the antenna elements. Each of the feed and support arrangements also supports a number of modules. The number of modules is related to the number of the antenna elements in the associated column of the two-dimensional array. Each module includes an antenna port and a beamformer port. Each feed and support arrangement also supports a first internal coupling arrangement coupled to the antenna ports of the modules mounted on the feed and support arrangement, and to the antenna element couplers, for, when the feed and support arrangement is in a first position, coupling transmit energy from the antenna ports of the modules to the antenna elements, and for coupling energy received by the antenna elements to the antenna ports of the modules. Each feed and support arrangement also supports a column beamforming arrangement including a common input port and a plurality of module ports, which are coupled to the beamformer ports of the modules. Each feed and support arrangement also couples energizing power to each of its TR modules. Each one of the feed and support arrangements, with its associated antenna couplers, TR modules, first internal coupling arrangements, and column beamforming arrangements, defines (a) a length in a direction parallel to the direction of elongation of the associated one of the columns of antenna elements, which is at least equal to the length of the associated one of the columns, (b) a width no greater than the column-to-column spacing of the antenna elements of the array, and (c), a third dimension, in a direction parallel to the normal to the array, which is large enough to accommodate the associated antenna couplers, modules, first internal coupling arrangement, column beamformer, and any other equipment supported by the one of the feed and support arrangements. A movable mounting arrangement is coupled to the feed and support arrangement and to the antenna element support structure, for holding the plurality of feed and support arrangements in a movable relationship with the antenna element support structure, with the forward edge of each one of the feed and support arrangements facing the rear side of the antenna array, with the length dimension of each of the feed and support arrangements extending parallel to the direction of elongation of the associated one of the columns of antenna elements and parallel to the length dimensions of others of the feed and support arrangements, with the third dimension of each one of the feed and support arrangement extending parallel to the normal, and with the width dimensions extending parallel to each other, whereby the feed and support arrangements are stacked behind the array, spaced apart by the column-to-column spacing. The movable support arrangement allows each one of the feed and support arrangement to move, independently of others of the feed and support means, in the forward direction from a rearward position until it reaches the first position, in which the coupling arrangement of the feed and support arrangement mates with the feed ports of the antenna elements of the associated one of the columns. The movable support arrangement also allows each of the feed and support arrangement to independently move in a rearward direction from the first position by at least a predetermined distance. The predetermined distance is selected so that, when one of the feed and support arrangements is moved to its rearward position, to place its modules to the rear of the rearmost portion of adjacent ones of the feed and support arrangements which are in their first positions, whereby the modules of any one of the feed and support arrangement can be accessed for maintenance from the rear of the two-dimensional array. In the case in which the antenna array is other than a rectangular array, the lengths of the feed and support arrangements will vary across the array. For convenience, each feed and support arrangement may be split into two or more independently movable portions.

DESCRIPTION OF THE INVENTION

Figure 1:
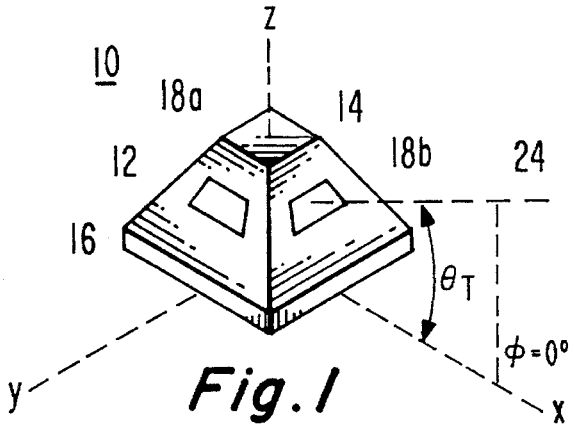
Fig. 1 PRIOR ART
FIG. 1 is a perspective or isometric view of a shelter as described in the prior art, which is adapted for supporting phased-array antennas.
Figure 2:
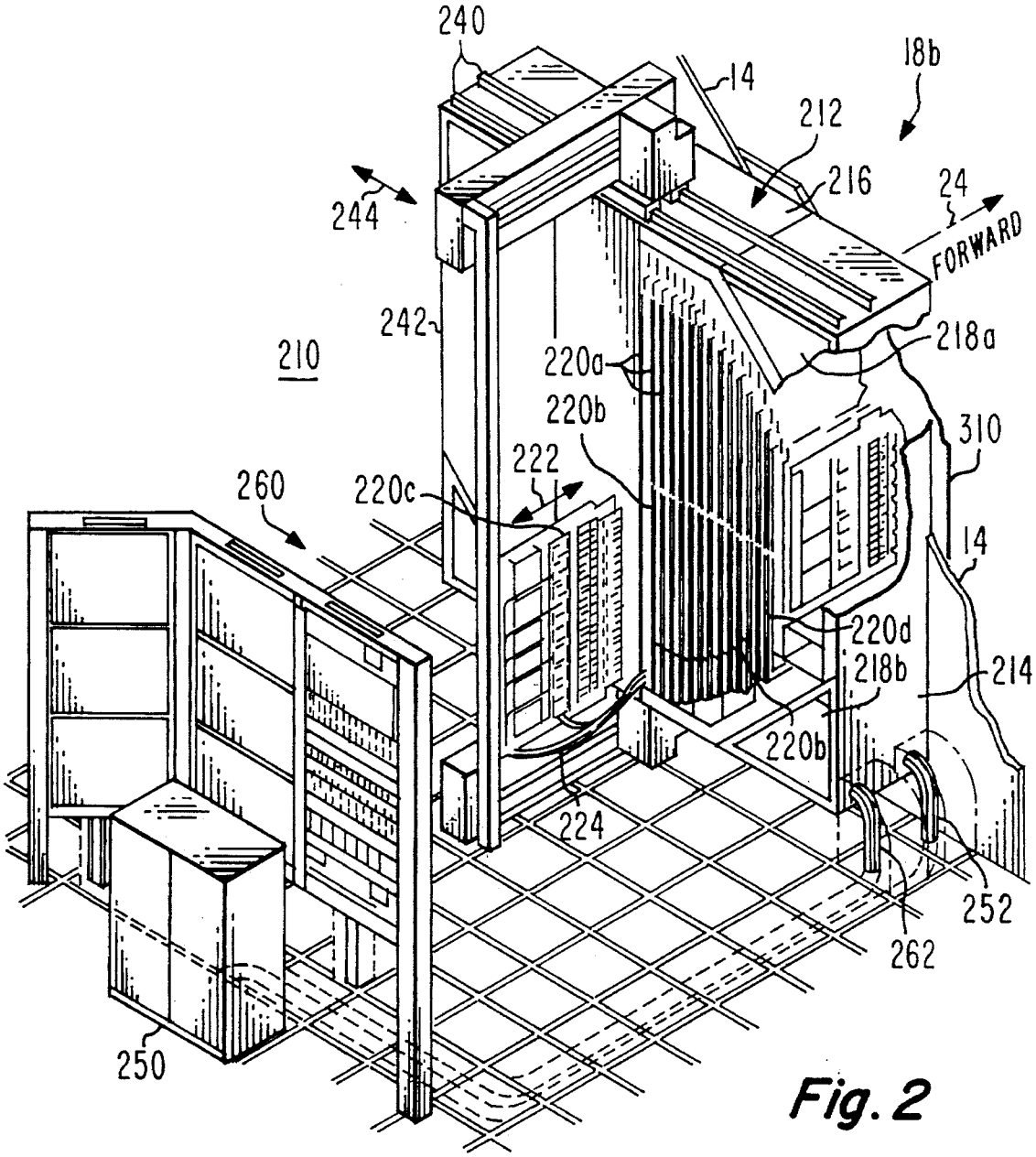
FIG. 2 is a perspective or isometric view, partially cut away to reveal interior details, of the phased-array antenna associated with one of the faces of the shelter of FIG. 1 and some of its associated controls and feed and physical support.

In FIG. 2, the phased-array antenna 210 associated with face 14 of the shelter of FIG. 1 is illustrated, cut away to reveal interior details. In FIG. 2, the exterior wall is designated 14. For generality, the antenna of FIG. 2 is illustrated as a circular array, rather than as a rectangular array as in FIG. 1. The antenna elements themselves are not visible in FIG. 2, but their radiating faces are contiguous with front wall 14, and they radiate generally in the forward direction indicated by the arrow associated with axis 24.

An antenna support arrangement designated generally as 212 in FIG. 2 includes vertical support members such as member 214, and horizontal support members such as 216, associated with support of the antenna elements adjacent to wall 14. Horizontal support member 216 defines a two-rail transverse track 240 associated with its upper surface. Further support members include diagonal corner support elements 218*a* and 218*b*.

The region behind the array of antenna elements is occupied by a plurality of vertically oriented feed and support arrangements 220, which are arrayed side-by-side, and which are ultimately supported by support arrangement 212. In the arrangement of FIG. 2, some of the feed and support arrangements 220 are, for strength and rigidity, divided into two portions, the upper of which are designated 220*a*, and the lower of which are designated 220*b*. Some of the feed and support arrangements near the edge of the array, such as feed and support element 220*d*, is not divided into two portions, because their lengths are not great. Each feed and support arrangement 220 is held in position by a track affixed to support arrangement 212, on which the associated feed and support arrangement 220 can slide in the forward and rear directions represented by arrow 222. All of the feed and support arrangements 220 illustrated in FIG. 2, except one, are in their most forward positions, while an exemplary one, as described below, is in its rearmost position.

An exemplary one of the lower feed and support arrangements, designated 220*c*, is illustrated in FIG. 2 as having been moved in the direction of arrows 222 to a position which is located to the rear of the remainder of the adjacent feed and support structures 220. As illustrated in FIG. 2, feed and support structure 220*c* is located near the center of the array. Details of feed and support structure 220*c* are described below in conjunction with FIG. 4, but in general the forward edge of feed and support structure 220*c* consists of a vertical or column array of antenna couplers adapted for mating with an associated column of antenna elements, a plurality of transmit-receive (TR) modules, logic modules and power control circuits, all of which are accessible from the sides of feed and support structure 220*c*. The feed and support arrangement may also provide cooling of the equipment mounted thereon, and at least some cooling of the antenna(s) associated therewith. Electrical power is coupled to feed and support arrangement 220*c* by a power cable, illustrated combined with a control cable and a coolant tube in an open loop 224. Loop 224 closes when feed and control arrangement 220*c* is moved from its illustrated rearmost position in a forward direction, so that the cables and tubes do not become tangled. Each feed and support arrangement 220*b* has a similar cable affixed to its lower side. A spring loaded pulley system is utilized to dress hoses and cables on the top of the upper feed and support arrangements.

A servicing aid is illustrated in FIG. 2 as a structure 242, which is mounted on track rails 240 of horizontal support member 216 and on a corresponding track of a corresponding lower horizontal support member (not illustrated), for being slidably movable in a transverse direction suggested by arrow 244. Servicing aid 242 is positionable behind, or to the rear of, any one of feed and support arrangements 220, and includes tracks onto which each of the feed and support arrangements 220 may be slid, to provide support which is more rigid than that available from pull-out or extensible tracks. Such support is important during servicing, because extensible tracks, if used, are not strong in a transverse direction, and might be bent if someone or something were inadvertently to bang against the extended feed and support arrangement. Especially in a shipboard environment, such impacts are to be expected. Once bent, the tracks would be difficult to replace without taking out a number of the adjacent feed and support arrangements, which would entail taking the array antenna as a whole off-line. One of the aspects of reliability is maintaining continuous operation. With the described transversely movable support arrangement, each feed and support arrangement 220 is firmly held in its extended position, and is unlikely to be moved even with a moderate impact. Even if some motion were to occur in the transverse direction, this would merely flex the feed and control cables 224, and no damage would be done.

In FIG. 2, beam steering control is housed in a cabinet 250, and the control signals are applied by way of a cable 252 for distribution to the various TR modules of the feed and support arrangements, for control of the phase shifters for directing the beam or beams of the antenna, all in known fashion. The radio-frequency or microwave signals to be transmitted are processed by a horizontal beamformer 260, and the processed signals are applied by cables designated 262 for distribution to the vertical beamforming portions (described below) of the various feed and support arrangements 220.

Figure 3A:
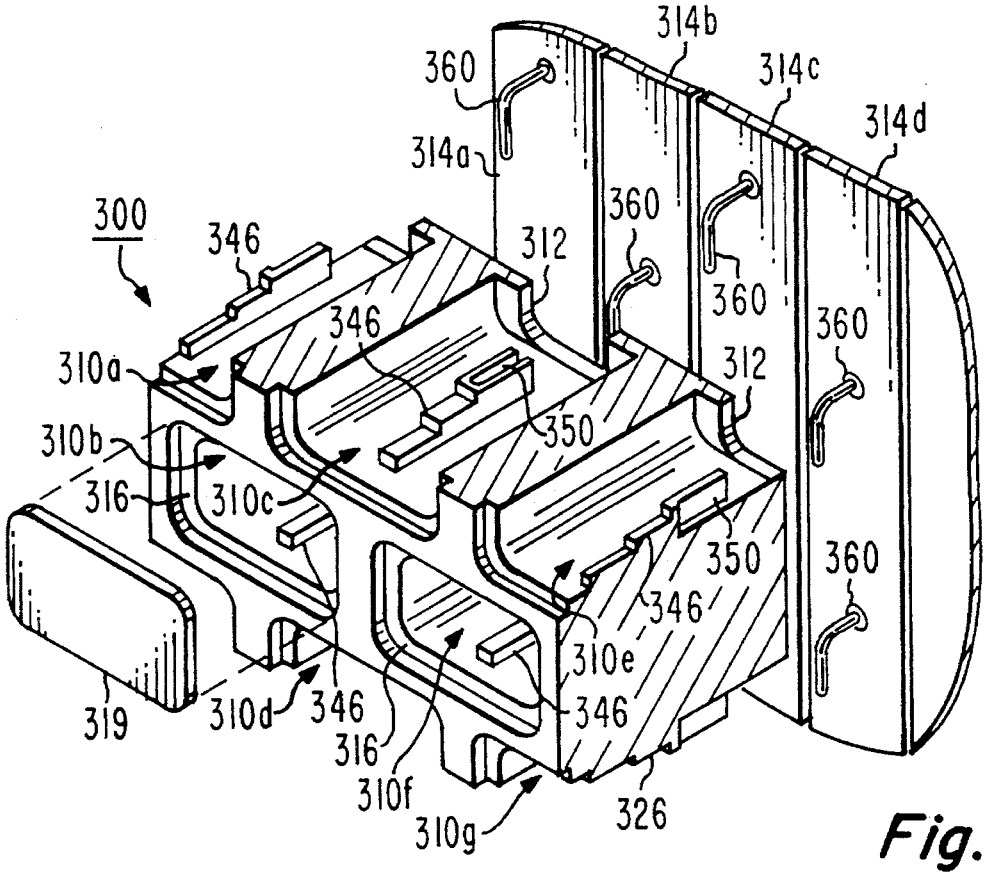
FIG. 3 is a perspective or isometric view of a portion of an array of horns which may be used in the arrangement of FIG. 2, exploded away from movable rear walls and associated probes which energize the antennas.
FIGS. 3*b* and 3*c* are front and rear elevation views of a portion of the horn array of FIG. 3*a;*

FIG. 3*a* is a perspective or isometric view of a portion of a horn array which may be used in the arrangement of FIG. 2, cut away to reveal interior details. The array of FIG. 3*a* is similar to that described in more detail in copending U.S. Pat. No. 5,359,339, issued Oct. 25, 1994 in the name of Agrawal et al., and entitled Broadband Short Horn Antenna. In FIG. 3*a*, a metal plate designated generally as 300 is milled to define plural waveguide horns 310*a*, 310*b*, 310*c*, 310*d*, . . . , 310*g*, not all of which are illustrated as being complete. Each horn 310 is associated with a stepped upper ridge 326 and lower ridge 346 integral therewith. A rear window or fenestration 312, smaller than the waveguide dimensions, is formed at the rear or feed end of each horn 310. Antennas 310 may be considered to be positioned in an array of columns; for example, complete antennas 310*b* and 310*f* are located in mutually adjacent columns, and horns 310*c* and 310*d* are located one over the other, in a single column. Other horns, not illustrated, are associated with the horns illustrated in FIG. 3*a*, in a plurality of side-by-side column arrays. A plurality of vertically elongated short-circuiting walls 314*a*, 314*b*, 314*c*, and 314*d*, support a plurality of probes 360 at locations such that, when any one of walls 314 is translated toward and into contact with metal plate 300, the probes pass through rear apertures 312 and into recesses illustrated as 350, to thereby feed the horns in a broadband manner. Electrical contact is made between each horn and its associated column shorting plate 314 by means of an elastic or springy conductive gasket (not illustrated), which is well known in the art. Sufficient force must be applied, using screws if necessary, to hold the gasket compressed. Each vertically oriented short-circuiting wall 314 is associated with one of the feed and support arrangements 220 of FIG. 2, and translates back and forth, i.e. in the forward and reverse directions, together with the associated feed and support arrangement, as it is moved between the two positions illustrated in FIG. 2.

In FIG. 3*a*, a single ceramic window 319 of a set of ceramic windows is illustrated. The windows are dimensioned to fit into a recess or flange 316 associated with a corresponding one of the horns 310, and may be held in place and sealed by an epoxy or silicone. These windows provide protection of the antenna elements against the environment, and keep salt spray out of the system when the antenna is used in a marine environment. There may be thousands of horn antenna elements in one phased array. If it were necessary to remove windows, such as window 319 from the front surface of the horn antennas during maintenance, it is likely that on occasion, the replacement of the window would be performed improperly, with the result that the horn might be damaged by corrosion due to window leakage. Once corrosive damage has begun, it becomes more difficult to achieve a proper seal. Leakage of water into a horn antenna, especially in a marine environment, may substantially change the impedance of the antenna and its radiation pattern, resulting in unwanted performance variations. Consequently, one of the aspects of the invention allows all maintenance to be performed from the rear of the array, thereby avoiding the necessity for removing any of the protective windows.

Figure 3B:
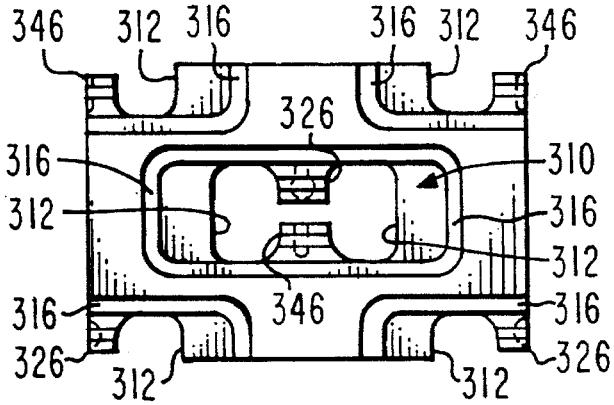
Figure 3C:
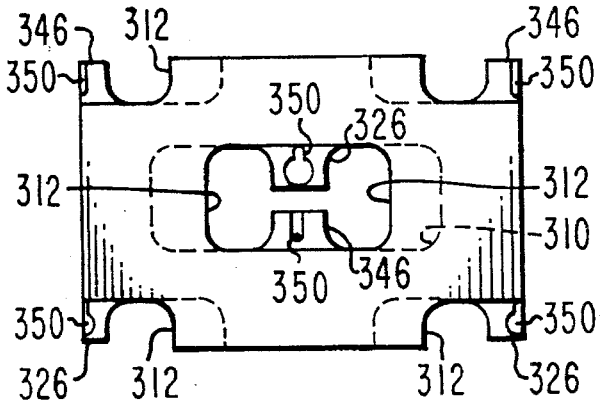

FIG. 3*b* is an elevation view of a portion of the array of FIG. 3*a* as seen from the near (radiating) side in FIG. 3*a*, while FIG. 3*c* is a corresponding view from the reverse (shorting wall) side.

Figure 4:
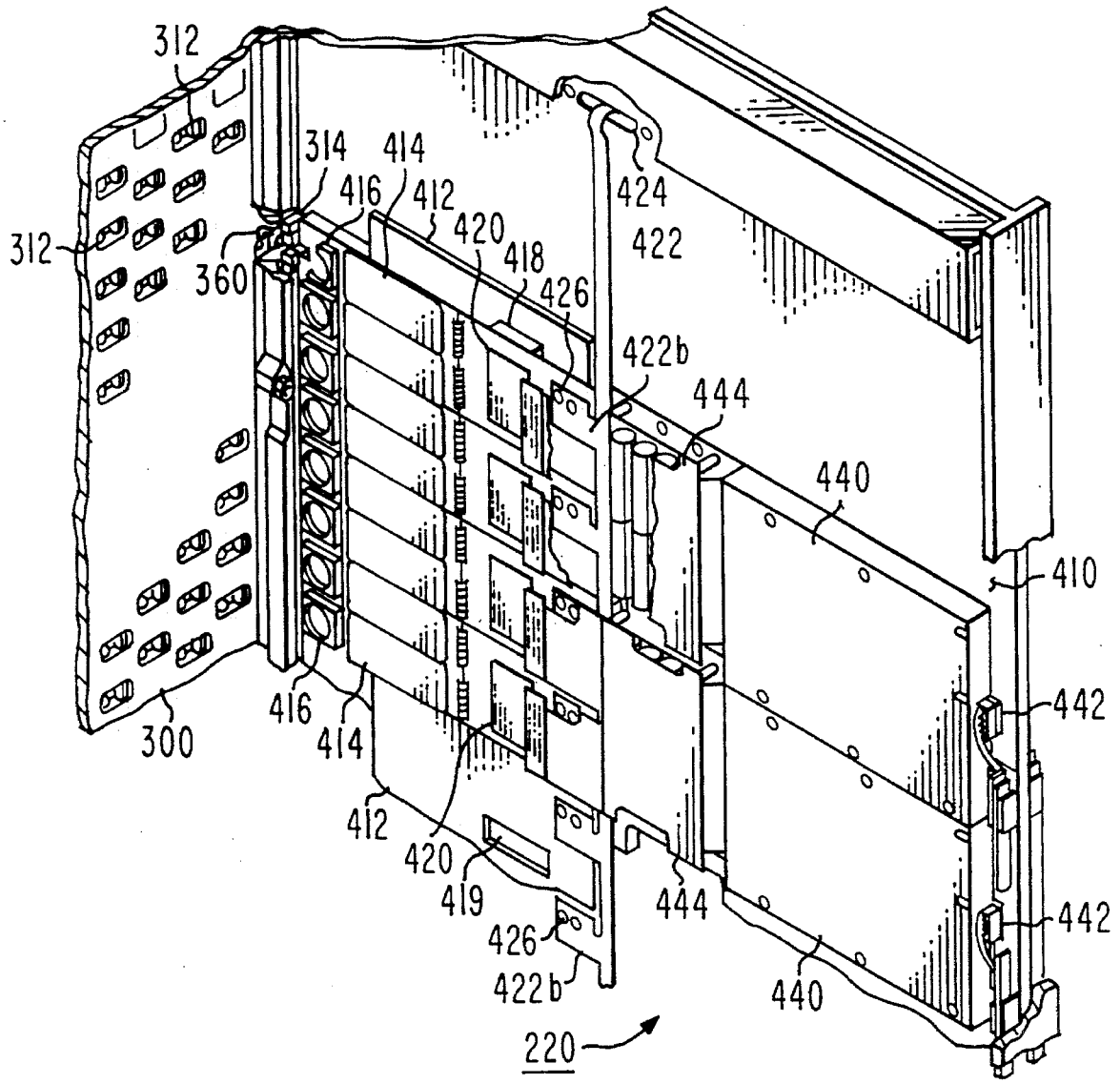
FIG. 4 is a simplified perspective or isometric view of a portion of a feed and support arrangement of FIG. 2, together with a portion of the array antenna of FIG. 3*a;*

FIG. 4 is a simplified perspective or isometric view of a portion of a feed and support arrangement 220. In FIG. 4, the rear or nonradiating side of metal plate 300 of FIG. 3 is visible, together with the array of rear apertures 312 of the antenna array. Feed and support arrangement 220 of FIG. 4 includes a cold plate 410 through which coolant fluid flows, and which supports a vertical beamformer 412. Vertical beamformer 412 is fed at the bottom from a coaxial cable (not illustrated) originating at horizontal beamformer 260 of FIG. 2. Vertical beamformer 412 includes RF or microwave power splitters and delay lines, all as known in the art, for ultimately feeding the antenna elements with the desired amplitude and phase distribution, usually a distribution which produces a beam approximately broadside to the array, or in the direction of axis 24 of FIGS. 1 and 2. Beam steering away from the broadside direction is accomplished, also as known, by controlled phase shifters or variable delay elements. An output of vertical beamformer 412 lies under each transmit-receive (TR) module 414, of which eight are shown. The eight TR modules of FIG. 4 have their heat-generating portions thermally mounted on bosses, extending from cold plate 412 through apertures in vertical beamformer 412. One of the apertures which is provided in vertical beamformer 412 to allow bosses to pass therethrough is illustrated as 419. One of the bosses which protrudes through an aperture in vertical beamformer 412 is illustrated as 418, although that boss does not lie under a TR module. Each TR module 414 is coupled to its associated horn probe or coupler 360 by a circulator 416, for providing isolation between the transmit power amplifier and the low-noise receive amplifier.

Each antenna element feed aperture 312 of the antenna array of FIG. 4 is associated with an individual transmit-receive module 414. Each transmit-receive module 414 includes low-noise and power amplifiers, and at least one controllable phase shifter, all as known to those skilled in the art, and as described, for example, in the abovementioned Gallagher et al. patent. The operational status of each TR module must be controlled between transmit and receive modes, the gain and phase shift must be controlled by commands, and other control functions may be required. A logic board or chip 420 is associated with each pair of TR modules 414. Each logic module 414 receives commands from beam controller 250 of FIG. 2, by way of cables which reach the feed and control arrangement 220 of FIG. 4 in the form of a ribbon cable or bus 422, which extends through a slot, and which has branches 422*b* terminating at connectors 426. Connectors 426 are coupled by conductors (not illustrated) to logic modules 420, for coupling commands arriving by way of ribbon cable 422 to the logic modules. One of the ways that logic module 420 may control a phase shifter portion of its associated TR module(s) 414, and other portions, is by controlling the voltage(s) applied thereto.

In FIG. 4, power supplies in the form of DC-to-DC converter modules receive energizing power over paths terminating at connectors 442. Each power supply module 440 supplies power for four TR modules 414, by way of the two associated logic modules 420. The output power produced by each power module 440 is filtered by a capacitor bank 444 before it is applied through the two associated logic modules to the four associated TR modules.

Figure 5:
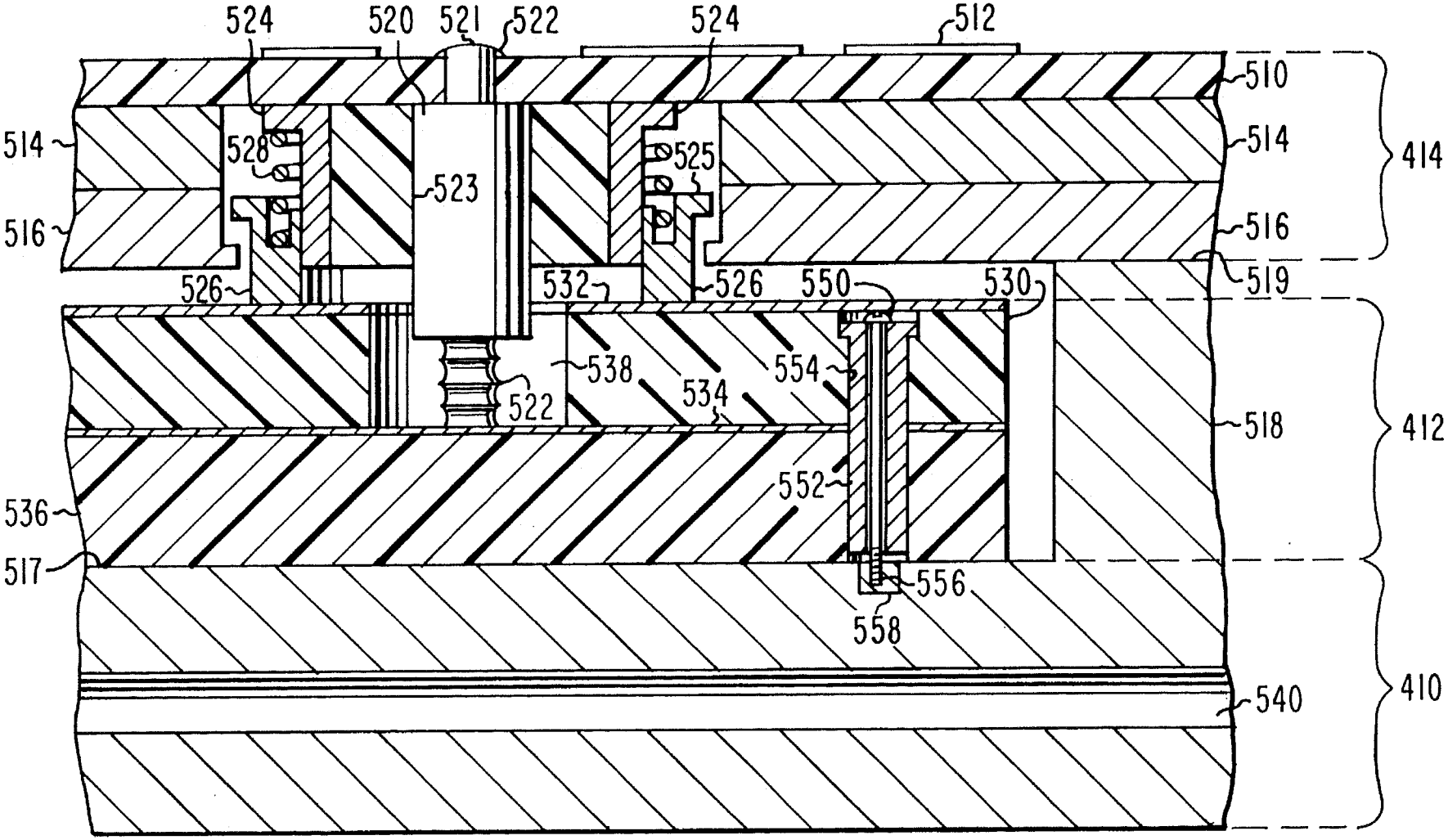
FIG. 5 is a simplified cross-section of cold plate 410 of FIG. 4, and of the various equipments mounted thereon, illustrating how the thermal and RF or microwave connections are made.

FIG. 5 is a simplified cross-section of cold plate 410 of FIG. 4, and of the various equipments mounted thereon, illustrating how the thermal and RF or microwave connections are made. In FIG. 5, cold plate 410 defines a tube or bore 540 through which coolant fluid may flow, and also defines a flat mounting surface 517 and a projecting boss 518. Vertical beamformer 412 is illustrated as including two main layers 530 and 536 of dielectric material. The upper surface of dielectric layer 530 is metallized with a layer 532 to define a ground plane, and further metallizations designated 534 represent the beamformer RF/microwave circuitry, sandwiched between dielectric layers 530 and 536. A screw 550 extends through a spacer 552 in a bore 554 formed through the dielectric layers of beamformer 412, and is threaded into a threaded hole 556 in an insert 558.

A further mounting surface 519 is defined at the top of boss 518 in FIG. 5. A portion of the lower surface of TR module 414 is coupled to surface 519, for transferring heat thereto. The thermal transfer may be facilitated by application of a heat conducting grease, if desired. As illustrated, TR module 414 includes a ceramic substrate 510, a copper/molybdenum heat sink or heat spreader 514, and an aluminum carrier 516. Various electronic modules and components, illustrated as 512, are mounted on the upper surface of TR module 414. These components may include thick or thin-film resistors, printed inductors and transmission-line elements having inductance or capacitance at the frequencies of interest, and may also include active devices in the form of chip transistors and/or microwave integrated circuits. A connection pin 520 includes a portion 521 which extends to the upper surface of ceramic layer 510 of TR module 414, and which makes electrical contact with metallizations of the upper surface by means of solder or braze 522. Connection pin 520 extends through a polymer dielectric washer 523 and a well 538 to the upper surface of a bellows connector 522, which takes up any spacing differences without introducing unwanted mechanical stress. This bellows connector is part number 2146, manufactured by Servometer, whose address is 501 Little Falls Road, Cedar Grove, N.J. 07009, for use with a connector pin 520 having a diameter of 0.060 inches. The lower end of bellows 522 bears on the upper surface of a metallization of layer 534. Unwanted electromagnetic transmission modes are suppressed by making pin 520 into the center conductor of a coaxial structure which includes an outer conductor comprising a metallic flange 524 and a flange extension 526. Flange extension 526 makes electrical contact with flange 524, and a spring 528 urges extension 526 into contact with ground plane 532. An annular lip 525 projecting from flange extension 526 prevents flange extension 526 from coming free of the TR module during assembly.

Figure 6:
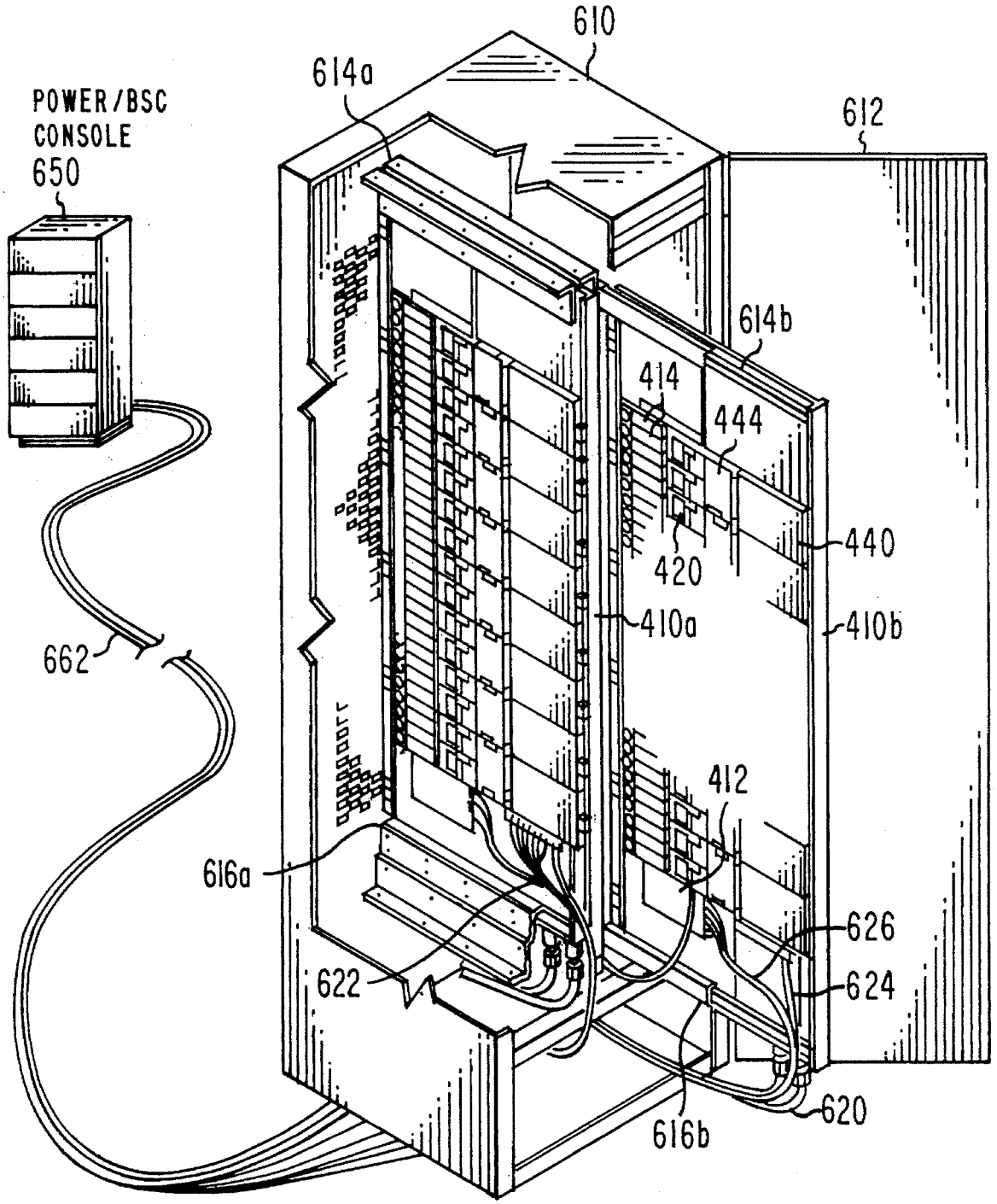
FIG. 6 is a perspective or isometric view, partially cut away to reveal interior details, of an experimental architecture in accordance with an aspect of the invention.

FIG. 6 is a perspective or isometric view, partially cut away to reveal interior details, of an experimental unit approximating the architecture described above in conjunction with FIGS. 1–5, where the hyphen represents the word "through". In FIG. 6, a cabinet 610 has a door 612 and a plurality of side-by-side upper extensible slides, illustrated as 614*a*, 614*b*. Upper extensible slides 614*a* and 614*b*, which are affixed to cabinet 610, together with lower extensible slides 616*a* and 616*b*, support cold plates 410*a* and 410*b*, corresponding to those described in conjunction with FIGS. 2–5. The TR modules are designated 414, and the logic or control modules are designated 420. Filter capacitor banks are designated 444, and dc-to-dc converters are designated 440. The lower end of the vertical beamformer of the extended cold plate is designated 412. The coolant fluid hose which connects to the extended cold plate is designated 620, and the power cable is 624. The logic or control cables are designated 622, and the RF or microwave coaxial cables are 626. Cable and hose bundle 662 carries all the power, control, RF/microwave cables, and the coolant hoses, to a further console 650, which includes a horizontal beamformer, source of coolant fluid, and controls appropriate for control of contents of cabinet 610.

Other embodiments of the invention will be apparent to those skilled in the art. For example, while the description of the invention has referred to "columns" this merely reflects the vertical orientation of the line array, which could as readily be horizontal, whereby the term "column" would more appropriately be "row," and should be so interpreted. While discrete ceramic windows are described in conjunction with the arrangement of FIGS. 3*a*, 3*b* and 3*c*, a single dielectric sheet may be used to cover all the antennas, if desired. While the invention describes the signals being transmitted as "RF or microwave," these are recognized as being generically equal, and as encompassing any frequency which it may be desired to transmit or receive, including, but not limited to, millimeter waves, long waves, and the like, as may be required by the application. While the antenna elements have been described as horns, other types of antenna elements may be used; where light weight is mandatory, as in airborne uses, the antenna elements may be printed-circuit patch antennas, or the like. While the logic modules have been described only as receiving commands, it is well known that the logic modules may also report back to a central location, as for example by periodically reporting the status of the various portions of the TR module and power supply with which it is connected. Each logic module 420 of FIG. 4 may control more or fewer than two TR modules, as desired, and each power supply 440 may supply its power to more or fewer than four TR modules, either directly, or by way of a logic module. Also, a single TR module may drive a plurality of antenna elements rather than only one.

What is claimed is:

1. An active array antenna, comprising;

a plurality of antenna elements, each including a feed side and a radiating side, said antenna elements being arrayed in a two-dimensional array over a two-dimensional array plane, with said radiating sides of said antenna elements facing in a forward direction relative to said two-dimensional array, and with said feed sides of said antenna elements facing in a rearward direction relative to said forward direction, each of said antenna elements of said two-dimensional array including a feed port facing generally toward said rear side of said two-dimensional array;

an antenna element support structure for supporting said antenna elements in columns in said two-dimensional array, and for allowing radiation generally in said forward direction from said antenna elements;

environmental protection means covering at least portions of said radiating sides of said antenna elements, for protecting said antenna elements from adverse environmental conditions;

a plurality of feed and support means, each of said feed and support means being associated with those of said antenna elements lying in a column of said two-dimensional array, each of said feed and support means being a) for supporting, along a forward edge of said feed and support means, a line array of antenna element couplers, the array direction of said line array of antenna element couplers being parallel to the direction of elongation of said column of said two-dimensional array, each of which antenna element couplers is adapted, in response to motion of said line array of antenna element couplers in a direction normal to said line array of antenna element couplers, for mating with said feed port of one of said antenna elements of said associated column, for, when mated coupling energy between said antenna element couplers and the associated ones of said antenna elements, b) for supporting a number of TR modules, which number is related to the number of said antenna elements in said associated column of said two-dimensional array, which TR modules include antenna ports and beamformer ports, c) for supporting first internal coupling means coupled to said antenna ports of said number of said TR modules and to said antenna element couplers, for coupling transmit energy from said antenna ports of said TR modules to said antenna elements, and for coupling energy received by said antenna elements to said antenna ports of said TR modules, when said feed and support means is in a first position, d) for supporting column beamforming means coupled to said beamformer ports of said TR modules, e) for coupling energizing power to each of said TR modules of said feed and support means;

each one of said feed and support means, with its associated antenna couplers, TR modules, first internal coupling means, and column beamforming means, defining a) a length in a direction parallel to the direction of elongation of the associated one of said columns of antenna elements, at least equal to the length of the associated one of said columns, b) a width no greater than the column-to-column spacing of said antenna elements, and c), a third dimension, in a direction normal to said array plane, which is large enough to accommodate said associated antenna couplers, TR modules, first internal coupling means, and column beamforming means supported by said one of said feed and support means;

movable mounting means coupled to said feed and support means and to said antenna element support structure, for holding said plurality of feed and support means in a movable relationship with said antenna element support structure, with said forward edge of each one of said feed and support means facing said rear side of said antenna array, with said length dimensions of each of said feed and support means extending parallel to said direction of elongation of the associated one of said columns and parallel to said length dimension of adjacent feed and support means, with said third dimension of each one of said feed and support means extending normal to said array plane, and with said width dimensions extending parallel to each other, whereby said feed and support means are stacked behind said array with said column-to-column spacing, for allowing each one of said feed and support means to move, independently of others of said feed and support means, in said forward direction from a rearward position until said one of said feed and support means reaches said first position, in which first position said coupling means of said one of said feed and support means mates with said feed ports of said antenna elements of the associated one of said columns, and for allowing each of said feed and support means to independently move in a rearward direction from said first position by at least a predetermined distance selected to place said TR modules to the rear of the rearmost portion of adjacent feed and support means in their first positions, whereby said feed and support means is removable for maintenance from the rear of said two-dimensional array.

2. An antenna according to claim 1, wherein said number of TR modules associated with each of said feed and support means is equal to the number of said antenna elements in said associated column of said two-dimensional array.

3. An antenna according to claim 1, wherein said predetermined distance is at least equal to said third dimension of said feed and support means.

4. An antenna according to claim 1, wherein each of said antenna elements comprises a horn antenna with a radiating aperture, and in which said feed port is an open waveguide, and wherein said coupling means comprises:

a shorting plate coupled to said forward edge of each of said feed and support means, for short-circuiting said open waveguide of each of said horn antennas of said column of antenna elements, said shorting plate defining an aperture associated with said waveguide of each of said horn antennas of said column of antenna elements; and an electric probe extending through each of said apertures in said shorting plate, to thereby excite an electric field in the associated one of said waveguides.

5. An antenna according to claim 4, wherein said environmental protection means comprises a dielectric window covering said radiating aperture of each of said horn antennas.

6. An antenna according to claim 1, wherein each of said feed and support means further supports a plural number of power supplies for generating direct voltage for energizing said TR modules, said plural number of power supplies being related to said number of said TR modules.

7. An antenna according to claim 6, wherein said plural number is equal to one-fourth said number of said TR modules, whereby each of said power supplies energizes four of said TR modules.

8. An antenna according to claim 6, wherein each of said feed and support means further supports a capacitor bank coupled to one of said power supplies and to at least some of said TR modules, for filtering said direct voltage.

9. An antenna according to claim 6, wherein each of said power supplies is a DC-to-DC converter.

10. An antenna according to claim 1, wherein each of said feed and support means further supports a beam direction control module coupled to at least one of said TR modules, for controlling at least a phase component of a signal processed by said one of said TR modules for directing a beam of said array.

11. An antenna according to claim 1, wherein each of said feed and support means further comprises a cold plate coupled by a thermally conductive path to at least a portion of each of said TR modules, for conveying heat away from said portion of said TR modules.

12. An antenna according to claim 11, further comprising a path for the flow of coolant fluid to said cold plate.

13. An active array antenna, comprising;

a plurality of antenna elements, each including a feed side and a radiating side, said antenna elements being arrayed in a two-dimensional array over a two-dimensional array plane, with said radiating sides of said antenna elements facing in a forward direction relative to said two-dimensional array, and with said feed sides of said antenna elements facing in a rearward direction relative to said forward direction, each of said antenna elements of said two-dimensional array including a feed port facing generally toward said rear side of said two-dimensional array;

an antenna element support structure for supporting said antenna elements in columns in said two-dimensional array;

environmental protection means covering at least portions of said radiating sides of said antenna elements, for protecting said antenna elements from adverse environmental conditions;

a plurality of antenna element couplers, each including at least one port;

a plurality of transmit-receive (TR) modules, which TR modules include antenna ports and beamformer ports;

a plurality of internal coupling means, each of which is coupled to said antenna ports of one of said TR modules and to a port of one of said antenna element couplers;

a plurality of feed and support means, each of said feed and support means being associated with those of said antenna elements lying in a column of said two-dimensional array, each of said feed and support means being a) for supporting, along a forward edge of said feed and support means, a line array of said antenna element couplers, the array direction of said line array of antenna element couplers being parallel to the direction of elongation of said column of said two-dimensional array, each of which antenna element couplers is adapted for mating with said feed port of one of said antenna elements of said associated column, for coupling energy between said antenna element couplers and the associated ones of said antenna elements, b) for supporting a number of said TR modules, which number is related to the number of said antenna elements in said associated column of said two-dimensional array, c) for supporting said first internal coupling means, for coupling transmit energy from said antenna ports of said TR modules to said antenna elements, and for coupling energy received by said antenna elements to said antenna ports of said TR modules, when said feed and support means is in a first position, d) for supporting column beamforming means coupled to said beamformer ports of said TR modules, e) for coupling energizing power to each of said TR modules of said feed and support means;

each one of said feed and support means, with its associated antenna couplers, TR modules, first internal coupling means, and column beamforming means, defining a) a length in a direction parallel to the direction of elongation of the associated one of said columns of antenna elements, at least equal to the length of the associated one of said columns, b) a width no greater than the column-to-column spacing of said antenna elements, and c), a third dimension, in a direction normal to said array plane, which third dimension is large enough to accommodate said associated antenna couplers, TR modules, first internal coupling means, and column beamforming means, which are supported by said one of said feed and support means;

movable mounting means coupled to said feed and support means and to said antenna element support structure, for holding said plurality of feed and support means in a movable relationship with said antenna element support structure, with said forward edge of each one of said feed and support means facing said rear side of said antenna array, with said length dimensions of each of said feed and support means extending parallel to said direction of elongation of the associated one of said columns and parallel to said length dimension of adjacent feed and support means, with said third dimension of each one of said feed and support means extending normal to said array plane, and with said width dimensions extending parallel to each other, whereby said feed and support means are stacked behind said array with said column-to-column spacing, for allowing each one of said feed and support means to move, independently of others of said feed and support means, in said forward direction from a rearward position until said one of said feed and support means reaches said first position, in which first position said coupling means of said one of said feed and support means mates with said feed ports of said antenna elements of the associated one of said columns, and for allowing each of said feed and support means to independently move in a rearward direction from said first position by at least a predetermined distance selected to place said TR modules to the rear of the rearmost portion of adjacent feed and support means in their first positions, whereby said feed and support means is extractable, whereby said TR modules of any one of said feed and support means is removable for maintenance from the rear of said two-dimensional array.

* * * * *